United States Patent [19]

Molitor

[11] 4,245,410

[45] Jan. 20, 1981

[54] FOAMED SKI BOOT

[75] Inventor: Robert P. Molitor, South Hadley, Mass.

[73] Assignee: Questor Corporation, Toledo, Ohio

[21] Appl. No.: 38,485

[22] Filed: May 14, 1979

Related U.S. Application Data

[63] Continuation-in-part of Ser. No. 830,688, Sep. 6, 1977.

[51] Int. Cl.[3] ..... A43B 5/04

[52] U.S. Cl. ..... 36/117

[58] Field of Search ..... 36/117, 118, 119, 120, 36/121, 45; 260/897 B, 42.43

[56] References Cited

U.S. PATENT DOCUMENTS

| | | | |
|---|---|---|---|
| 2,971,278 | 2/1961 | Scholl | 36/45 X |
| 3,819,768 | 6/1974 | Molitor | 260/42.43 X |
| 3,896,202 | 7/1975 | Palau | 36/117 |
| 3,968,292 | 7/1976 | Pearman et al. | 36/45 X |

*Primary Examiner*—Patrick D. Lawson

*Attorney, Agent, or Firm*—Donald R. Bahr

[57] ABSTRACT

A ski boot having an outer shell which is formed from a structural polymeric foam. The density of the foam may be uniform or it may vary throughout the cross-section of said outer shell. The foam likewise incorporates inner and outer skins which may or may not be impermeable.

20 Claims, 9 Drawing Figures

FIG. 2
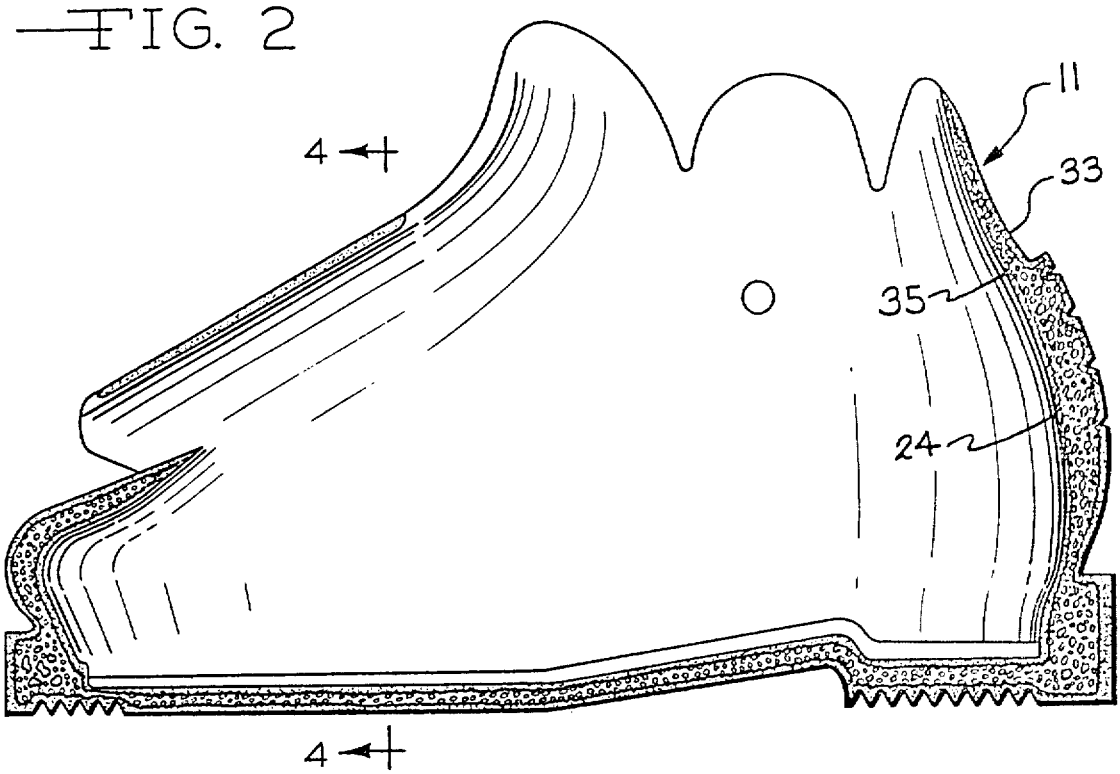
FIG. 3
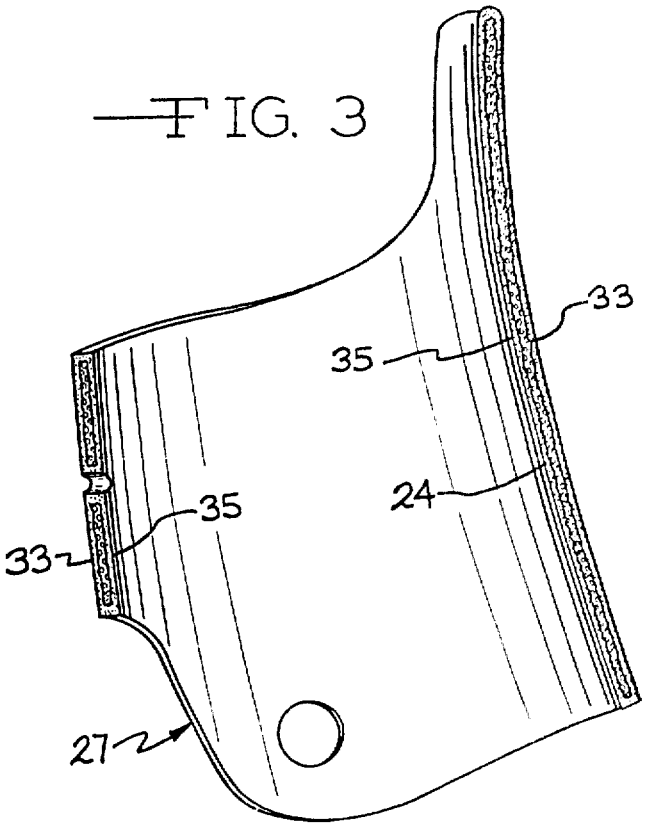
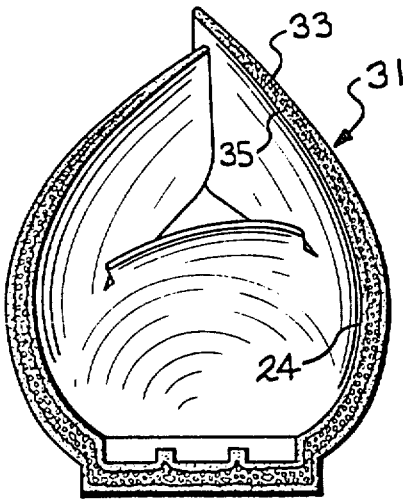
FIG. 4

FOAMED SKI BOOT

BACKGROUND OF THE INVENTION

This application is a continuation-in-part of application Ser. No. 830,688 filed Sept. 6, 1977.

This invention relates in general to boots, and in particular to ski boots having an outer shell which is formed from a structural foam, said foam having relatively dense inner and outer skins.

Substantially all of the ski boots now being manufactured are no longer made of leather, but are constructed of semirigid plastic outer shells which may also use inner padding of sponge rubber, expanded shredded foam or other material designed so that the wearer's foot fits comfortably within the shell with relatively little movement. These boots have a performance and durability advantage over leather boots and, additionally, provide significant economic advantages in the production of the boot. Additionally, one of the major advantages has been to provide a reduction in weight over the prior art boots.

There have constantly been attempts to reduce the overall weight of the boot while maintaining the structural strength characteristics which are required for a proper ski boot. Additionally, in view of the rising costs of material used in this type of boot, any savings which can be made through the reduction of the amount of the material used will provide a substantial reduction weight of the boot and its cost.

Accordingly, it is an object of this invention to provide a light weight boot which provides the necessary insulation and weight/strength ratio.

A further object is to produce a light-weight, comfortable boot.

A further object of this invention is to provide a boot of reduced weight having increased weight/strength ratio.

A further object of this invention is to provide a ski boot having a shell with a foamed interior structure with relatively dense impermeable inner and outer skins.

Another object of this invention is to provide a ski boot having an outer shell which is formed from a structural polymeric foam wherein said outer shell is permeable to air, but impermeable to moisture.

S till another object of this invention is to provide a ski boot having an outer shell which is formed from a structural polymeric foam wherin said outer shell has permeable inner and outer skins.

These and other objects of the invention will become apparent from the following description taken together with the accompanying drawings.

BRIEF SUMMARY OF THE INVENTION

The present invention provides a boot which has an outer shell which is formed from a structural polymeric foam. The cross-section of said shell may have an impermeable outer skin and a dense impermeable inner skin with a cellular foam structure may be of the same material and may be formed so as to be a unitary construction. While it is preferrable that the cell density of the foam be uniform, it may be varied for different locations of the boot if desired.

BRIEF DESCRIPTION OF THE DRAWINGS

FIG. 2 is a sectional view taken along the lines 2—2 of FIG. 1;

FIG. 3 is a sectional view of the boot section taken along the lines 3—3 of FIG. 1;

FIG. 4 is a sectional view of the boot section taken along the lines 4—4 of FIG. 3;

DETAILED DESCRIPTION OF A PREFERRED EMBODIMENT OF THE INVENTION

Figure 1:
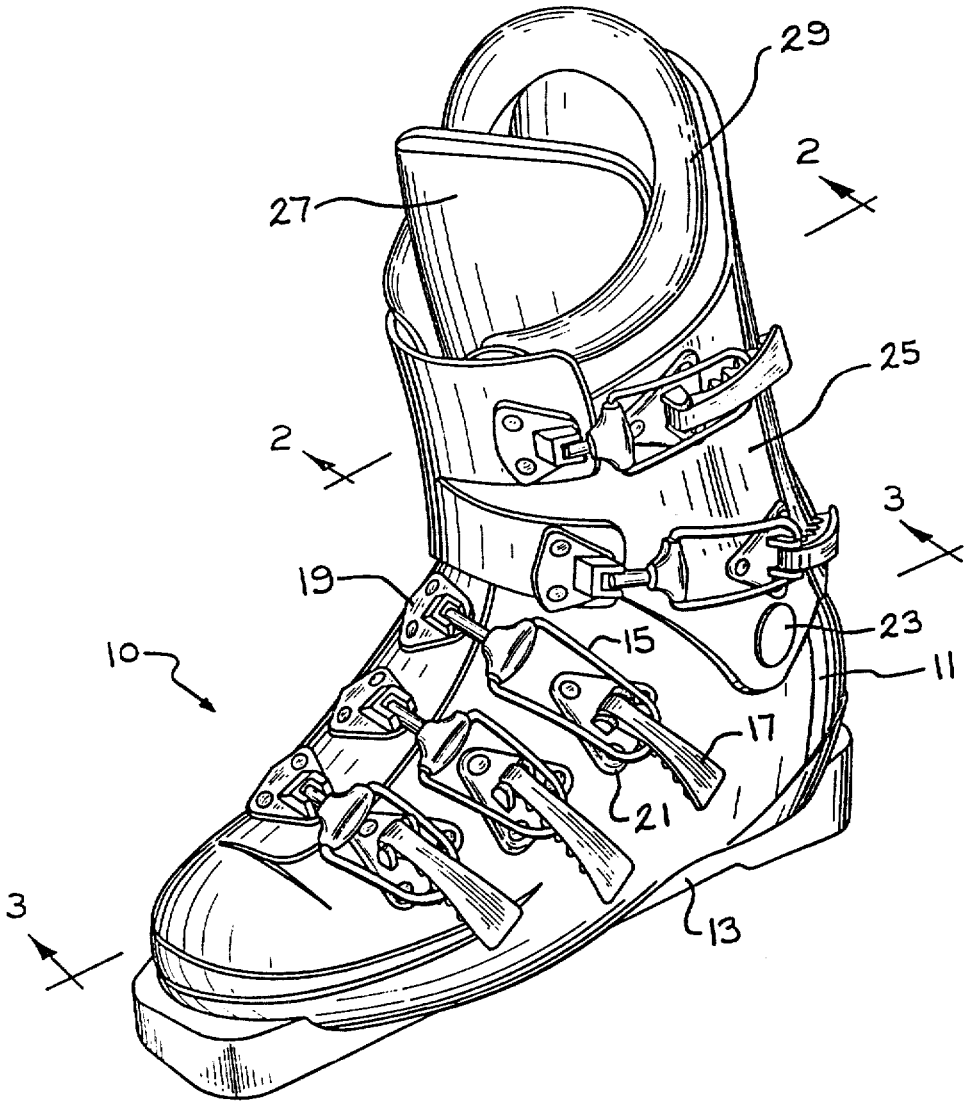
FIG. 1 is a perspective view of the boot, ankle cuff, tongue and snow collar.

Turning now to FIG. 1, there is shown a ski boot 10 which comprises a boot section 11 and a sole 13 together with the latching system. This system includes the bail 15 and buckle 17. Various boots use different numbers of buckles, but a relatively standard design is shown which uses three buckles on the boot section.

Toward the heel of the boot section 11, there is shown an integral mold botton 23. A similar button is on the opposite side of the boot, and these bottons are designed in order that the ankle cuff 25 may be secured to the boot section 11. The ankle cuff also includes the desired numbered of bails and buckles.

A tongue 27 extends downwardly into the boot and may be surrounded by a snow collar 29. These items are also standard equipment used in the ski boot.

FIGS. 2 through 5 show the construction of the boot which specifically relate to the present invention. Each of the sectional views illustrate a cross-sectional view taken through the outer shell. As shown in FIG. 2, the outer shell is comprised of an outer skin 33 and an inner skin 35. These skins are formed in situ during the molding of the structural polymeric material so as to form skins of varying thicknesses which may be permeable or impermeable. The inner part of said cross-section is cellular. This cellular structure is formed from the same structural polymeric material as the inner and outer skins 35 and 33. When a boot is molded in accordance with this invention, each section of the resulting boot has a unitary cross section. That is, the foam section 24 and the outer and inner skins 33 and 35 are integral.

FIG. 3 is a sectional view of the ankle cuff showing that it, too, has the shell structure of the inner and outer skins 33 and 35 and inner foam cellular structure 24.

FIG. 4 shows a section through 4—4 of FIG. 3 and illustrates the toe section 31 having the inner and outer skin layers 33 and 35 with the cellular foam structure 24 therebetween.

Polymeric materials capable of forming cellular structures are necessary to this invention. Such materials are known in the art and are generally prepared with blowing agents, nucleated agents, and other additives as necessary to create the desired structures. Because the resin materials must form substantially cellular-type structures, thermoplastic materials are generally preferred. However, thermosetting resins can be likewise used in accordance with this invention. Typical, but not limitative of the properties desirable for the resin are good flowability, moderate stiffness, high abrasion resistance, high tear strength, and good mold release among others. Preferred polymeric materials for use in accordance with this invention are ionomer resins comprising a copolymer of ethylene and an unsaturated monocarboxylic acid which is available under the trademark Surlyn from E. I. duPont de Nemours & Company of Wilmington, Delaware.

In a typical embodiment, about 88 percent by weight of a copolymer of ethylene and methacrylic acid in the form of pellets is dry blended with about 4 percent by weight sodium bicarbonate as a blowing agent, and about 8 percent by weight of barium sulfate as a nucleating agent. If desired, a coloring pigment in an amount generally less than about 3 percent based upon the weight of the mixture may optionally be added. A minor amount of mineral oil may be employed to prevent segregation of the materials after they are blended to obtain a substantially uniform admixture. Upon completion of the mixing, the dry blend is fed to the foam-injection hopper for processing in accordance with this invention. The foam is then enjected under pressure into a mold so as to form the desired structure.

Ionomers for use in accordance with this preferred embodiment of this invention are sold by E. I. duPont de Nemours & Company in two principle forms; these being sodium and zinc base ionomers. In these instances, the ionomer chain includes either a zinc ion or a sodium ion. While it is understood by one skilled in the art that many thermoplastic polymer materials can be used in accordance with this invention, it is preferred that a mixture of zinc and sodium ionomers be used to form the outer shell of the boot in accordance with this invention. In the preferred embodiment, a mixture of 80 parts sodium ionomer with 20 parts zinc ionomer is utilized. The preferred resins for use in this mixture are as follows:

A sodium base ionomer resin which is sold under the designation Surlyn #8198 and zinc base ionomer resin which is sold under the trademark Surlyn #1855.

The formulation and fabrication of mixtures of Zinc and Sodium base Surlyn resins is also described in U.S. Pat. No. 3,819,768 which relates to golf ball technology.

The above description relates to the preferred embodiment of this invention wherein ionomers are used as a polymer material. A wide range of thermoplastic materials can be used in accordance with this invention in lieu of said Surlyn materials. Suitable polymer materials which may be also adapted to this invention are as follows:

Homopolymeric and copolymeric substances, such as (1) vinyl resins formed by the polymerization of vinyl chlorides or by the copolymerization of vinyl chlorides with unsaturated polymerizable compounds, e.g., vinyl esters; (2) polyolefins such as polyethylene, polypropylene, polybutylene, polyisoprene, and the like, including copolymers of polyolefins; (3) polyurethanes such as are prepared from polyols and organic polyisocyanates; (4) polyamides such as polyhexamethylene adipamide; (5) polyesters such as polybutylene terephthalates; (6) polycarbonates; (7) polyacetals; (8) polystyrene, high impact polystyrene and acrylonitrile, butadiene styrene copolymers; (9) acrylic resins as exemplified by the polymers of methyl-methacrylate, acrylonitrile, and copolymers of these with styrene, etc.; (10) thermoplastic rubbers such as urethanes, copolymers of ethylene and propylene, and transpolyisoprene, block copolymers of styrene and cispolybutadiene, etc.; (11) cellulose esters including the nitrate, acetate, propionate, butyrate, etc.; (12) polysulfones, and; (13) polyphenylene oxide resins and a blend with high impact polystyrene known by the tradename "Noryl". This list is not meant to be limiting or exhaustive, but merely to illustrate the wide range of polymeric materials which may be employed in the present invention.

The various sections of a ski boot made in accordance with this invention have a unique inner and outer skin separated by a cellular foam. This structure results in a final ski boot having distinct advantages.

The weight reduction of the overall boot is substantial compared with any made of the same material having a constant solid density. for example, a Surlyn boot made as discussed above was produced at a weight of 560 to 570 grams. A comparable solid Surlyn shell would weigh approximately 670 to 680 grams. A solid urethane shell that is currently in production weight approximately 860 to 870 grams.

This weight reduction obviously means that there is a savings in material and, therefore, a substantial savings in cost of production of the boots.

Further, in view of the inner cellular construction, there is a substantial increase in insulation, thereby providing body heat retention and preventing the penetration of the cold through to the human foot.

This particular structure also provides a very good weight/strength ratio. The foam core, with two outer skins, is semi-rigid and this rigidity is advantageous in that the boot may be designed to properly contain and support the foot in the proper areas.

In the case of Surlyn foam, there is a variation in yield under high/low speed loading. Therefore, it will comfortably give under walking conditions, but under severe sudden pressures encountered on the ski slope, it shows increased resistance to yield.

Figure 5:
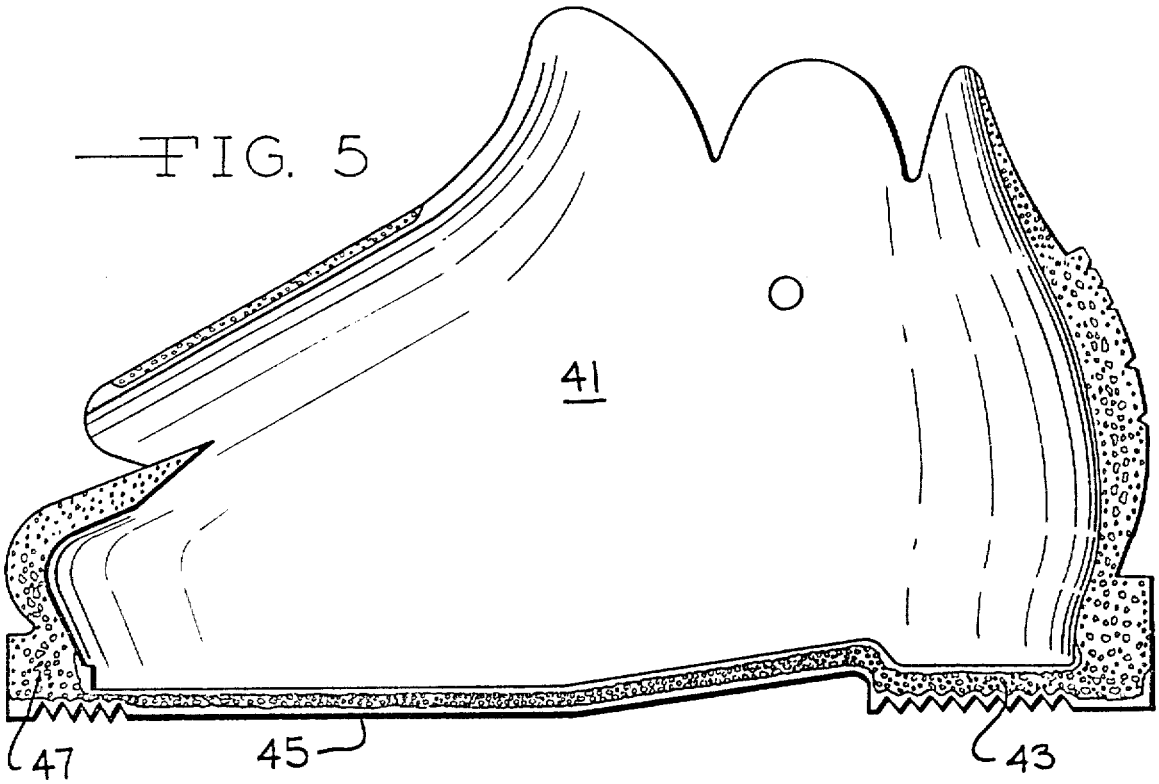
FIG. 5 is a partial sectional view of the boot section showing different densities of the cellular foam material in differing locations of the boot.

Normally, it would be preferred that the boot incorporate a uniform cell structure throughout the entire boot. This construction is shown in FIGS. 2, 3 and 4. However, in some instances, it may be desirable to vary the cell structure between certain sections of the boot. Such a boot 41 is shown in FIG. 5 wherein the heel 43 contains a cellular structure of one density, whereas the sole 45 and toe 47 contain differing cellular densities. This, again, allows great leeway in design and production.

As has been mentioned above, the cross-section of the outer boot shell can be varied in order to achieve different physical and mechanical properties in the resultant product. Specifically, an outer boot shell can be formed with a variety of skins which vary from a dense, impermeable skin to a permeable membrane. Three different embodiments of polymeric structural foams which are useful in this invention are illustrated in FIGS. 7, 8 and 9.

Figure 7:
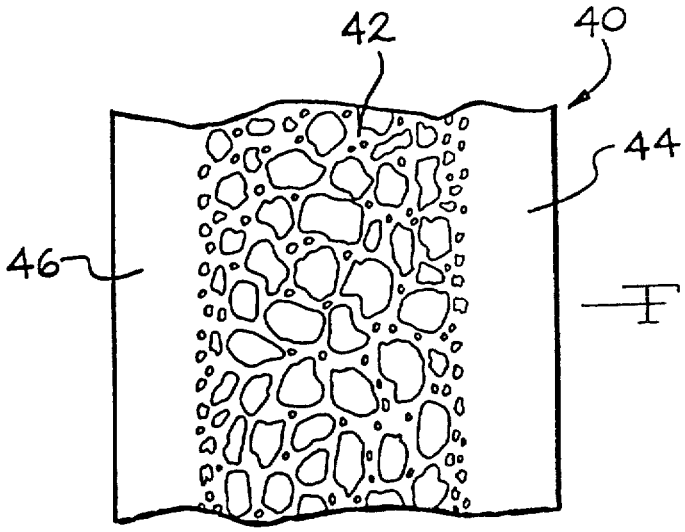
FIGS. 7, 8 and 9 illustrate other embodiments of structural polymeric foams which may be used in this invention.

In FIG. 7, we have a cross-section 40 which has a foam core 42 and a pair of opposing dense impermeable skins 44 and 46. Skins 44 and 46 are essentially unblown polymeric material, although it is understood by one skilled in the art that skins 44 and 46 may have trace minute cells. Skins 44 and 46 are essentially impermeable to both moisture and air. A structure, such as structure 40, would be used in a ski boot when it is desirable to prevent the permeation of both moisture and air.

Figure 8:
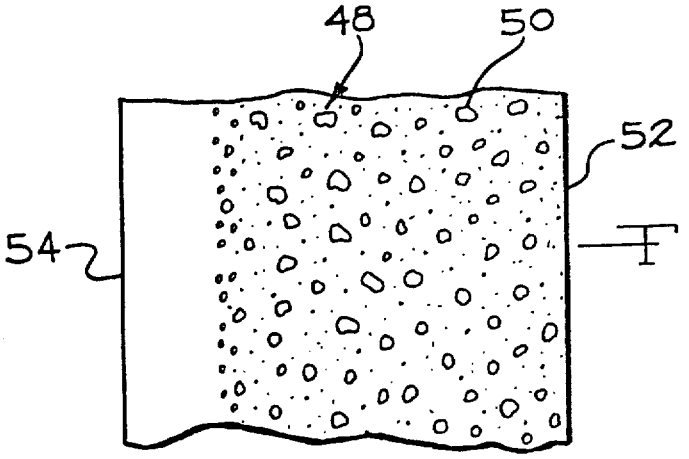

Still another embodiment on foam which is useful in this invention is illustrated in FIG. 8. In this figure, we have essentially a polymeric section 48 which has a uniform cell structure 50 which is surrounded by membrane 52 and skin 54. Because skin 54 is tougher than membrane 52 it is usually positioned outwardly.

Figure 9:
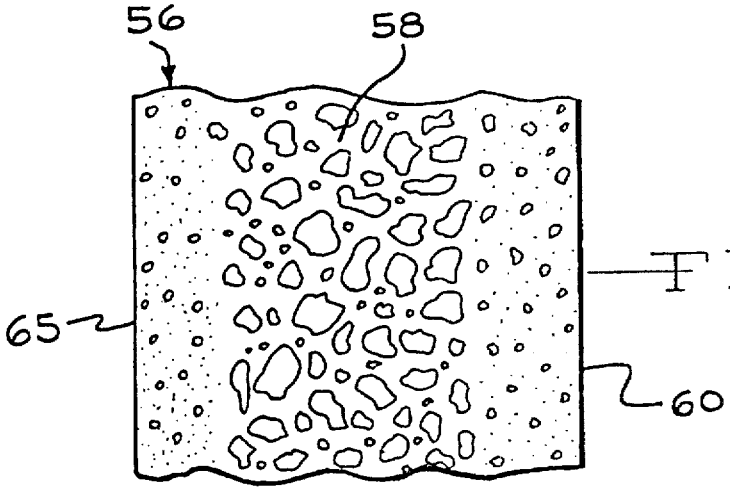

FIG. 9 illustrates still another embodiment of polymeric structure 56 which is useful in this invention, and structure 56 incorporates a central cell structure 58 and a pair of opposing cellular skins 60 and 62. the permeation of skins 60 and 62 will be affected by the density of the cells in skins 60 and 62.

As can be seen from an examination of FIGS. 7 and 8, the various skins 44, 46, 60 and 62 can be varied in order to achieve desirable ends in the ultimate ski boot. These skins may be varied by many means. for example, the skin can be varied by varying the temperature of the mold during the initial stages of the injection molding process and by the cooling rate of the mold, and one skilled in the art is aware of the other parameters, such as melt temperatures, injection time, injection speed, injection pressure, nozzle type, gating, venting, holding pressure and time, shot weights, the amount of blowing agent and nucleators, as well as polymeric composition, mold surface treatment and mold lubricant, are among other factors that control the characteristics of the foam cell structure as well as skin integrity.

It is also a well known fact, depending upon the chemical blowing agent utilized, one can produce a unicellular foam structure or an inner connecting cell structure. In the case of the unicellular structure, except for the permeability of the material utilized, it is essentially non-breathable. In the instance of inner connecting cells, one develops a breathable foam regardless of the permeability of the polymeric material utilized, since all cells are connecting, and therefore, breathable. It should, however, be noted that even after injection molding a particular part., there have been methods established to make a unicellular structure breathable either through mechanical electrical perforation or by other methods available to one skilled in the art.

It can, therefore, be concluded that either working with a blowing agent such as bicarbonate or a nitrogen bearing compound, one can produce any of the three structures illustrated in FIGS. 1–5 of this application to be more or less permeable or impermeable as desired.

In the above described process for the formation of the outer boot shell of this invention, various components can likewise be molded into said shells for cosmetic or strength purposes or to aid in the attachment of said shells to bindings.

Further, it is understood by one familiar with in situ blowing processes that a wide range of blowing agents may be utilized to effect the foaming of the polymeric material. Examples of suitable blowing agents are as follows: azobisformamide; azobisisobutyronitrile; diazoaminobenzene, N,N-dimethyl-N, N-dinitroso terephthalamide; N,N-dinitrosopentamethylene-tetramine; benzenesulfonyl-hydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbazide; barium azodicarboxylate; butylamine nitrile; nitroureas; trihydrazino triazine; phenylmethylurathane p-sulfonhydrazide; and sodium bicarbonate.

These blowing agents generally function by their thermal decomposition which creates in situ gas that is abosrbed by the melt and then when pressure is released on the melt, expands to form the foam. In addition to this, it is within existing commercial knowledge that injecting a gas, such as nitrogen, air, trichlomonofluoromethane, carbondioxide, etc., into the melt in the accumulator chamber that the gas is then absorbed and, again upon release of pressure, allows the melt to expand into a foam.

The preferred embodiment of this invention utilizes a nitrogen generating blowing agent which is susceptible to thermal decomposition.

Naturally, the percentage of blowing agent utilized in accordance with this invention will vary with the physical and chemical properties of the blowing agent so utilized. In accordance with the preferred embodiment of this invention, from 0.1 to 0.5% of Ficel EPA is utilized based on the weight of the thermoplastic ion. Ficel EPA is a trademark used in conjunction with a blowing agent which is essentially azodicarbonamide. ficel EPA is available from Sobin Chemicals, Inc., Sobin Park, Boston, Massachusetts 02201.

As to the actual forming process, the components of the subject invention may be formed by injection molding the entire shot in less than one second into a cool mold at 70° F. with almost immediate withdrawal of the cylinder and nozzle from the mold to allow the proper forming of skin and foam. A cycle time of 60–90 seconds is easily obtainable working with a shuttle last so that the part can be stripped from the last while another part is in the process of being formed or molded. Extreme care, particularly with Surlyn resins need be taken to keep moisture content in the resin at as low a level as is possible, preferably below 0.5%. This is accomplished by proper drying techniques familiar with one skilled in the art. By the same token, any moisture on the surface of the mold due to humidity conditions will adversely affect the part appearance.

A ski boot shell made from foamed Surlyn resin in this manner of this invention will weigh about 30% less than a comparable solid urethane shell that is currently in vogue and about 20% less than a boot shell formed from unfoamed Surlyn resin.

Figure 6:
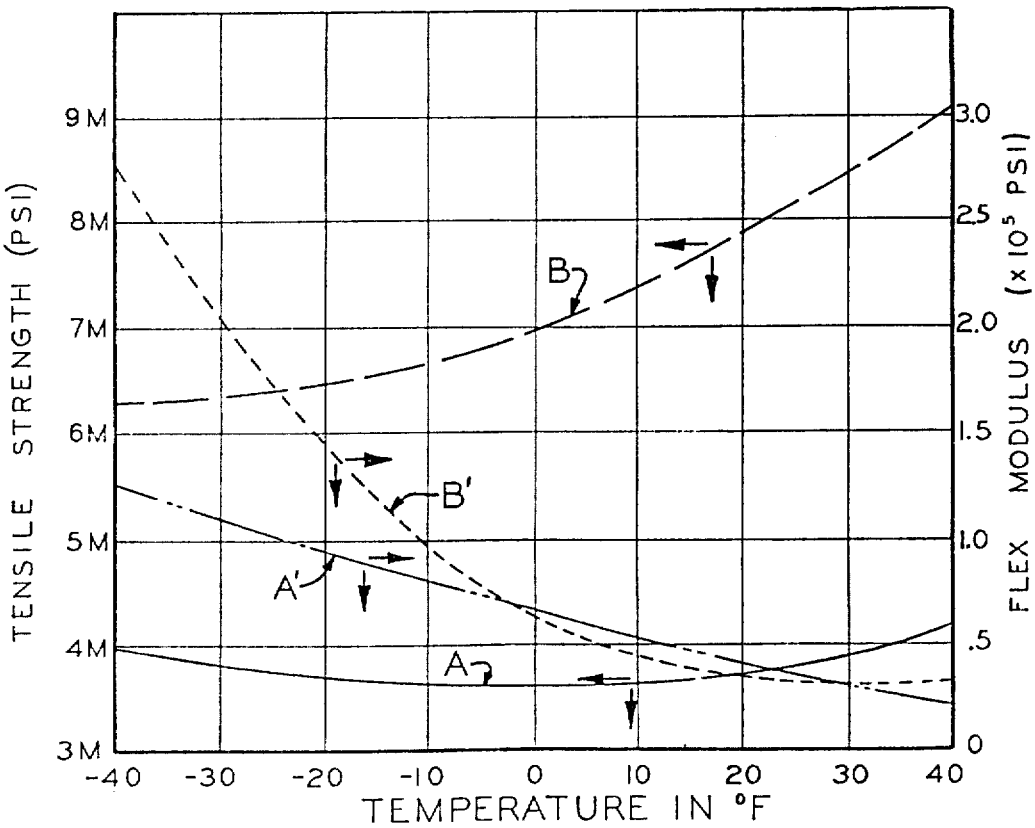
FIG. 6 illustrates a graph which demonstrates the desirable physical properties of ski boots made in accordance with this invention.

Ski boots in use are normally subjected to usage at very low temperatures. In order to be satisfactory, a ski boot must function properly under a wide range of temperatures which will generally vary between about −30° F. to about 100° F. Hence, the low temperature physical characteristics of the boot, including its outer shell, are extremely important. FIG. 6 illustrates that ski boots incorporating the outer shell of this invention exhibit superior low temperature physical properties when compared to the conventional, dense, solid counterpart. Referring to FIG. 6, it can be generally said that the flatter the line, the more advantageous the physical properties. Line #A and $A^1$ of FIG. 6 represents plotted data illustrating the physical properties of an outer shell in accordance with this invention. It can be seen that these lines are relatively flat compared to lines #B and #$B^1$. The flatness of lines #A and $A^1$ is generally indicative of the fact that the cold temperature physical properties of the outer shell do not vary significantly over the temperatures in which one would normally expect ski boots to be utilized. The steep curves of lines #B and #$B^1$ indicate that the prior art ski boots exhibit rapidly changing physical properties over the operating temperature range in which ski boots may be utilized. Rapidly changing physical properties are particularly disadvantageous in that the feel of the boots and hence the safety of the boots change drastically, depending on the temperature in which the boots are being utilized.

In addition to the advantageous flexual modulus properties as are discussed above relative to FIG. 6, the flexual modulus of the foam polymeric material for use in accordance with this invention must have sufficient structural integrity in order to function as an outer shell of a ski boot. It is evident fom the prior art and from the above discussions that the use of sponge rubber and foam polymeric materials is known in footwear and ski boots. These prior art applications have been used primarily to provide a readily conformable medium which is useful in fitting the boot to the foot and further to enhance the insulation properties of the boots. In contrast to these prior art structures, the subject inventions uses structural foam polymeric materials. Because these materials provide structural integrity to the boot, they must be relatively stiff. In order to function in accordance with this invention, these structural foam materials must have a flexual modulus of at least $0.025\times10^5$ psi. In accordance with the more preferred embodiment of this invention, the flexual modulus is from about 0.05 to about $0.30\times10^5$ psi. In accordance with the most preferred aspect of the subject invention, the flexual modulus is about $0.1\times10^5$ psi. The flexual moduli of the materials as specified above were measured in accordance with ASTM Test No. D790.

Referring to FIGS. 7, 8, and 9, it should be noted that skins 44, 46, 54, 60, and 62 can vary in thickness. The thickness of these skins can be varied by many means for example by varying the mold temperatures. The relative thicknesses of these skins can likewise be varied at different points in the boot structure. This can be accomplished by selectively heating or cooling given portions of the mold.

The density of the core section and the thickness of the skins of the boot sections in accordance with this invention can likewise be varied by the injection techniques. The injection techniques in question are well understood by one skilled in the art and include such variables as the ram forward time, injection speed, shot size, gate size, mold venting, injection pressure, holding pressure, etc.

It is within the purview of this invention to add to the thermoplastic materials used to make the ski boots of this invention compatible materials which do not affect the basic and novel characteristics of the composition of this invention. Among such materials are coloring agents, including dyes and pigments, fillers and similar additives. Additives such as antioxidants, antistatic agents, and stabilizers may also be added. The upper limit of the quantity of additives is usually about 5 weight percent of the product.

The term "consisting of" as used in the definition of the ingredients present in the claimed ski boot and in the below listed examples is intended to exclude the presence of other materials in such amounts as to interfere substantially with the properties and characteristics possessed by the composition set forth but to permit the presence of other materials in such amounts as not substantially to affect said properties and characteristics adversely.

What is claimed is:

1. A ski boot having an inner boot and an outer shell said outer shell being formed from a structural polymeric material having a flexual modulus of at least $0.025\times10$ psi, which incorporates an outer skin, an inner skin, and a foam core there between, wherein said outer skin, said inner skin, and said foam core are integral and are formed in situ.

2. The boot of claim 1 wherein said polymeric material is a member selected from the group consisting of polyurethane resins, polyalphaolefin resins and ionic polyethylene resins sold under the trademark Surlyn.

3. The boot of claim 1 wherein at least one of said inner and outer skins is permeable.

4. The boot of claim 1 wherein both of said inner and outer skins is impermeable.

5. The boot of claim 1 wherein the cell structure of said foam core is substantially uniform throughout said boot.

6. The boot of claim 1 wherein the cell structure of sid foam core varies in density throughout said boot.

7. The boot of claim 2 wherein at least one of said inner and outer skins is permeable.

8. The boot of claim 2 wherein both of said inner and outer skins are impermeable.

9. The boot of claim 2 wherein the cell structure of said foam core is substantially uniform throughout said boot.

10. The boot of claim 2 wherein the cell structure of said foam core varies in density throughout said boot.

11. The boot of claim 1 wherein the polymeric material is a mixture of a sodium base ionic polyethylene as sold under the trademark Surlyn 8198 and a zinc base ionic polyethylene as sold under the trademark Surlyn 1855.

12. The boot of claim 11 wherein said mixtures consist of 80% of said sodium base ionic polyethylene and 20% of said zinc base ionic polyethylene.

13. The boot of claim 11 wherein at least one of said inner and outer skins is permeable.

14. The boot of claim 11 wherein both of said inner and outer skins are impermeable.

15. The boot of claim 11 wherein the cell structure of said foam core is substantially uniform throughout said boot.

16. The boot of claim 11 wherein the cell structure of said foam core varies in density throughout said boot.

17. The boot of claim 1 wherein the flexual modulus of said structural polymeric material is from about 0.05 to about $0.30\times10^5$ psi.

18. The boot of claim 4 wherein the flexual modulus of said structural polymeric material is from about 0.05 to about $0.30\times10^5$ psi.

19. The boot of claim 11 wherein the flexual modulus of said structural polymeric material is about $0.1\times10^5$ psi.

20. The boot of claim 13 wherein the flexual modulus of said structural polymeric material is about $0.1\times10^5$ psi.

* * * * *